US005241125A

United States Patent [19]

Miyamoto

[11] Patent Number: 5,241,125

[45] Date of Patent: Aug. 31, 1993

[54] EDITING APPARATUS FOR AUTOMATIC MUSICAL PLAYER

[75] Inventor: Hiromu Miyamoto, Hamamatsu, Japan

[73] Assignee: Yamaha Corporation, Hamamatsu, Japan

[21] Appl. No.: 958,605

[22] Filed: Oct. 6, 1992

Related U.S. Application Data

[63] Continuation of Ser. No. 784,773, Oct. 30, 1991, abandoned.

[30] Foreign Application Priority Data

Oct. 31, 1990 [JP] Japan ..... 2-293808

[51] Int. Cl.[5] ..... G10H 1/06; G10H 1/42

[52] U.S. Cl. ..... 84/609; 84/611; 84/622; 84/DIG. 12

[58] Field of Search ..... 84/609-614, 84/622-625, 634-638, DIG. 12, DIG. 22, DIG. 29

[56] References Cited

U.S. PATENT DOCUMENTS 4,981,066 1/1991 Kakizaki et al. ..... 84/613

4,993,306 2/1991 Ueta et al. ..... 84/635 X

*Primary Examiner*—Stanley J. Witkowski

*Attorney, Agent, or Firm*—Graham & James

[57] ABSTRACT

An automatic musical editing apparatus is presented which permits easy and efficient alterations of tone generation timing while listening to a musical score. The apparatus employs a CPU 1 which controls the overall function of the apparatus according to the steps stored in memories, and interfaces with the various sections through a bus B. The RAM memories are used to store rhythm pattern data, including a header region HD for storing temporary data, followed by a duration data to specify the generation timing for the first tone DU1, followed by an event data IV1 to specify the first tone. The remaining tones are stored in the same alternating pattern of timings and corresponding tones. The end of the rhythm pattern is indicated by the end data ED. The capability of moving the tone generation timing to a desired location in a score is referred to as the move clock function, and is effected by operating a timing alteration device, a wheel 5, which permits transferring a generation timing to a desired fore and aft location of the present tone location, in proportion to the magnitude of the rotation of the wheel 5.

13 Claims, 5 Drawing Sheets

EDITING APPARATUS FOR AUTOMATIC MUSICAL PLAYER

This is a continuation of copending application Ser. No. 07/784,773 filed on Oct. 30, 1991 and now abandoned.

BACKGROUND OF THE INVENTION

This invention relates to a method of editing of musical playing data for automatic musical playing instruments and a device therefor.

BACKGROUND ART

Electronic musical instruments having automatic playing capabilities are known, and some are equipped with a capability or a device for editing musical data to provide control of automatic playing.

In such editing facility and electronic musical apparatuses, it is sometimes necessary to adjust the tone generation timing. In conventional apparatuses, such operation is performed by means of editing devices attached to automatic musical data editing facility, by setting the operational mode to editing mode and entering the necessary changes to the duration data of the relevant event data through a ten-key pad. After the duration data are altered, the operational mode is switched back to the automatic playing mode to listen to confirm the changes made to the tone generation timing. Since tone generation timing alterations are performed numerically, it is difficult to transfer the generation timing to a desired location. Further, the operational procedures were cumbersome since the apparatus required frequent switching between the modes in order to confirm the effects of timing adjustments.

SUMMARY OF THE INVENTION

The objective of the present invention is to resolve such problems existing in the current models of editing devices, by presenting an editing apparatus which makes it possible to alter the duration data of an event data of interest while in the automatic playing mode.

Accordingly, the present invention presents an automatic musical data editing apparatus comprising:

(a) memory means for storing the rhythm tone data for controlling musical generation according to tone generation event data and tone generation timing data which control the generation timing of said event data;

(b) an operating means for changing the musical play control timing in accordance with said event data;

(c) a timing alteration data generating means for generating the timing alteration data in accordance with the operation of said operating means;

(d) controlling means for controlling the event data and timing data according to either a first choice or a second choice; wherein said first choice comprises the steps of reading event data and timing data stored in said memory means, and outputting the event data according to the timing data; and said second choice comprises the steps of reading event data and timing data stored in the memory means, and altering the timing data in accordance with the timing alteration data, and outputting the event data in accordance with the altered timing data.

(e) tone generation means for generating musical tones in accordance with the event data outputted from said controlling means.

Accordingly, the invented apparatus so equipped is able to perform tone generation process in accordance with the altered tone generation timing which may be placed in a location specified by the magnitude of the output signal from the timing means.

The invented apparatus thus provides an effective method for effortless editing of a musical score by permitting simultaneous listening and modifying of the tone generation timing.

PREFERRED EMBODIMENTS OF THE PRESENT INVENTION

Figure 1:
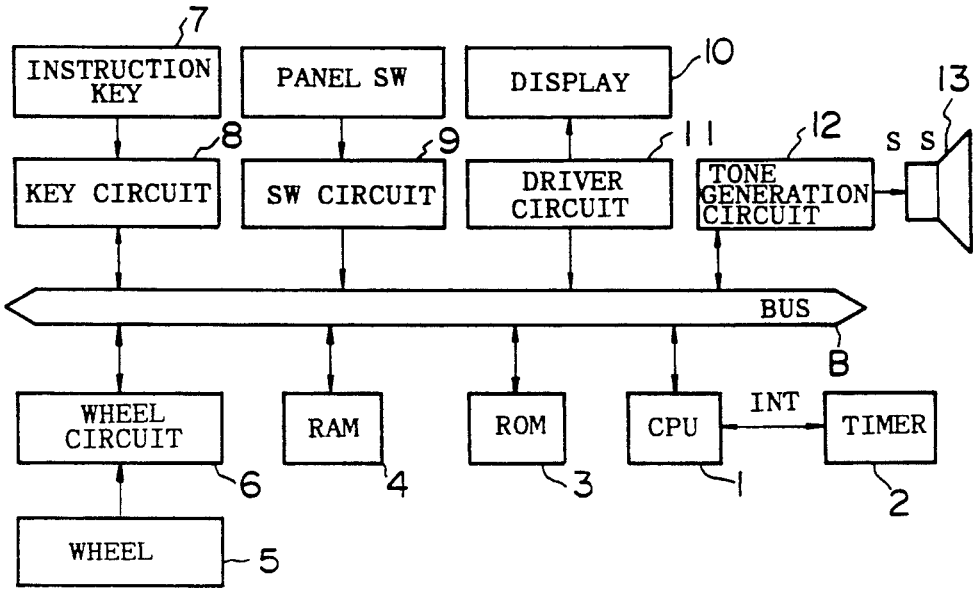
FIG. 1 is a schematic block diagram for the construction of the automatic editing apparatus according to an embodiment of the invention.
Figure 2:
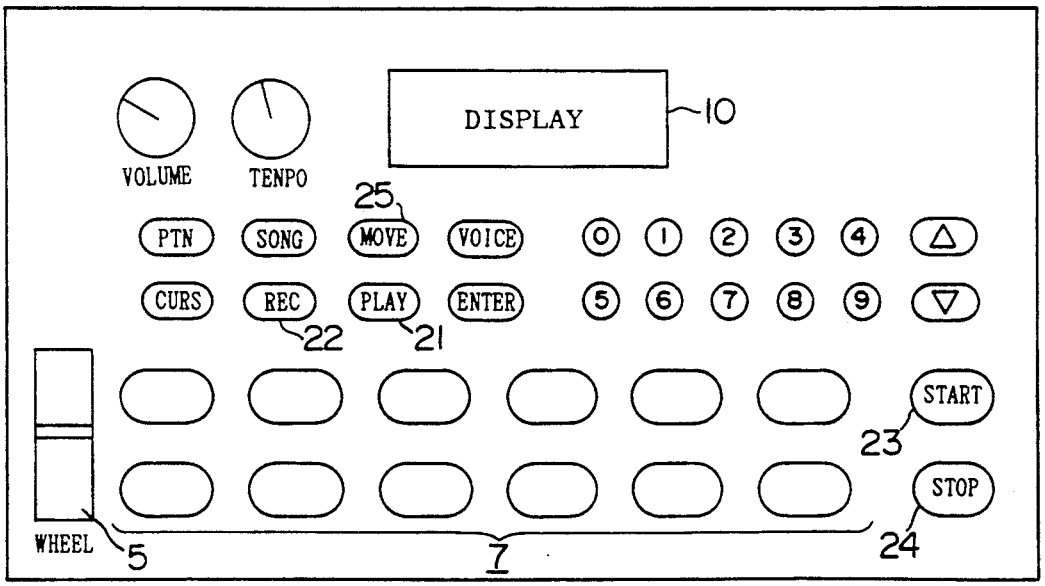
FIG. 2 is a plan view of the operation panel of the embodiment.

FIG. 1 is a block diagram of a musical data editing apparatus for automatic musical player in a preferred embodiment. FIG. 2 is a plan view of the operation panel of the apparatus shown in FIG. 1. This editing apparatus has capabilities to edit rhythm patterns and to play back musical based on the edited rhythm patterns.

In FIG. 1, CPU 1 (central processor unit) directs the entire function of the editing apparatus, and provides data input/output functions through a bus B. The timer 2 supplies timer interrupt signal INT periodically to CPU 1. ROM 3 (read only memory) stores various executive programs for CPU 1.

Figure 3:
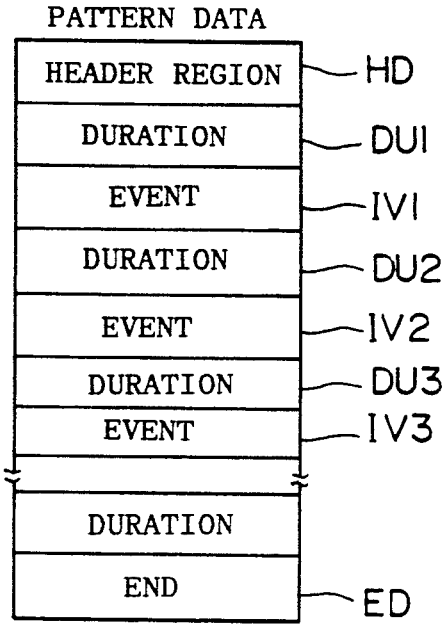
FIG. 3 shows the memory format of the embodiment.

Each area of RAM 4 (random access memory) is used as flags or as registers to store various control data. Specified memories in RAM 4 are used as rhythm pattern storage areas which stores automatic player data for the rhythm patterns. The memory format for the rhythm patterns is shown in FIG. 3. As shown in this figure, the head address of the rhythm pattern memory locations is designated as the header region HD for storing data such as tempo data for the rhythm patterns. The addresses of the header region contain duration data DU 1 to specify the time duration to the first rhythm tone generation, followed in series, by an instruction to generate the first rhythm tone event IV 1. This pattern of data storage is repeated so as to alternate one duration data and one rhythm pattern data in the address locations. At the end of such a series of events, there is an end data ED to signal the end of the current rhythm pattern.

On the operation panel is provided a freely rotatable wheel 5 (refer to FIG. 2), and the rotating motion of the wheel 5 is converted to a digital signal (hereinafter referred to as wheel value) in proportion to the amount of rotation of the wheel 5 by the wheel output circuit 6.

The invented editing apparatus features an editing capability (defined as move clock capability) to edit a score by transferring the tone generation timing of a certain desired rhythm tone to a desired location while the rhythm tone is generated on the basis of automatic playing data which are stored in RAM 4. When the editing apparatus is set to the move clock mode, the rotation of the wheel 5 causes the tone generation timing immediately following the current event to be transferred forward or backward to a spot in proportion to the amount of rotation of the wheel 5.

Figure 4:
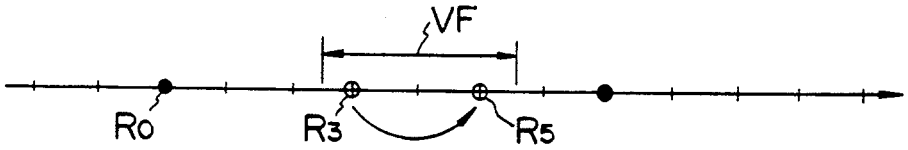
FIGS. 4 and 5 illustrates the transfer process of the rhythm tone generation timing effected by a timing means.

In more detail, the transfer of the tone generation timing (hereinafter referred to as the timing) of a tone is accomplished as follows. FIG. 4 illustrates a case of delaying (transfer to a backward spot) the timing of a desired rhythm tone $R_3$, and VF is related to the duration of the rotation of wheel 5. Referring to this figure, the operator first confirms the generation of a tone $R_0$ which precedes the planned tone $R_3$, and turns the wheel 5 in the positive direction prior to the generation event of the tone $R_3$. This positive rotation motion is continued at least until past the planned generation time of the tone $R_3$. This step alters the duration data of the rhythm tone $R_3$ in proportion to the positive rotation of the wheel 5, and the rhythm tone $R_3$ is generated at a new time spot shown, for example, as $R_5$.

Figure 5:
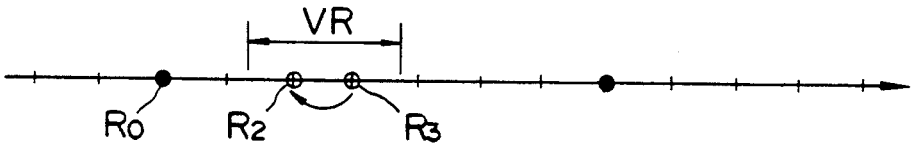

FIG. 5 illustrates a case of advancing the timing for rhythm tone $R_3$, and as before VR refers to the duration of the rotation of wheel 5. In this case also, the operator first confirms the generation of the preceding tone $R_0$, and rotates the wheel 5 in the negative direction prior to the planned generation timing of $R_3$. This negative rotation motion is continued at least until past the original planned generation time of the tone $R_3$. This step alters the duration data of the rhythm tone $R_3$ in proportion to the negative rotation of the wheel 5, and the rhythm tone $R_3$ is generated at a new time spot shown, for example, as $R_2$.

Referring to FIG. 1, on the operation panel SW are provided several instruction keys shown in FIG. 2. These instruction keys 7 are used to specify the tone color of the various rhythm tones, and each key is designated for a certain musical instrument. When a key 7 is pressed, key circuit 8 responds by generating tone color directive data specific to the instrument, which are forwarded to CPU 1 through the bus B.

Switch circuit 9 is for the remaining keys, other than the instruction keys 7, such as play key 21, record key 22, start key 23, stop key 24 and move clock key 25, and senses the operational state of the keys and forwards the operational data to CPU 1. Display 10 displays the status of the various operating sections, and driver circuit 11 drives the display 10 according to the display data supplied by CPU 1. The tone generation circuit 12 generates rhythm tones corresponding to the various tone colors, and the sound system 13 generates sound of the rhythm tones generated by the tone generation circuit 12.

Figure 6:
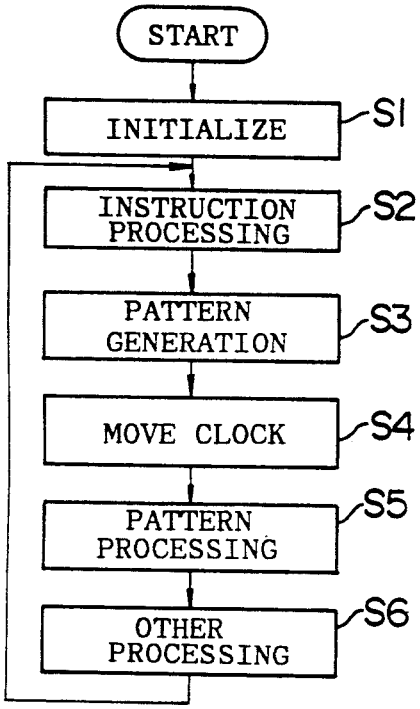
FIGS. 6 and 7 are flow charts to explain the overall steps involved in the embodiment.

Next, the operative steps of the embodiment presented above will be explained. When the electrical power (not shown) to the editing apparatus is supplied, CPU 1 begins processing according to the main routine shown in FIG. 6. In step S1, the initialization step is carried out, which sets the initial values in registers and flags in RAM 4. For example, elapsed time management functions such as time registers TIME and preceding time register OT are set to [0]. The move clock flag MOVE for specifying the move clock function is set to "0". In step S2, processing of instruction keys, i.e., scanning of the output of the key circuit 8 is performed, and any operational instruction data outputted from the key circuit 8 are read into CPU 1.

In step S3, rhythm tone generation pattern is produced (referred to as rhythm pattern). If the operational mode is "record", and if the operational data for the instruction key 7 had been made available in S2, the operational data are recorded as event data, and the operational interval data as duration data in the rhythm pattern memory locations of RAM 4. In this case, the apparatus is set to "recording" mode if the operator presses the record switch 22 first, followed by the start switch 23, and is cancelled if it is followed by the stop switch 24.

Figure 8:
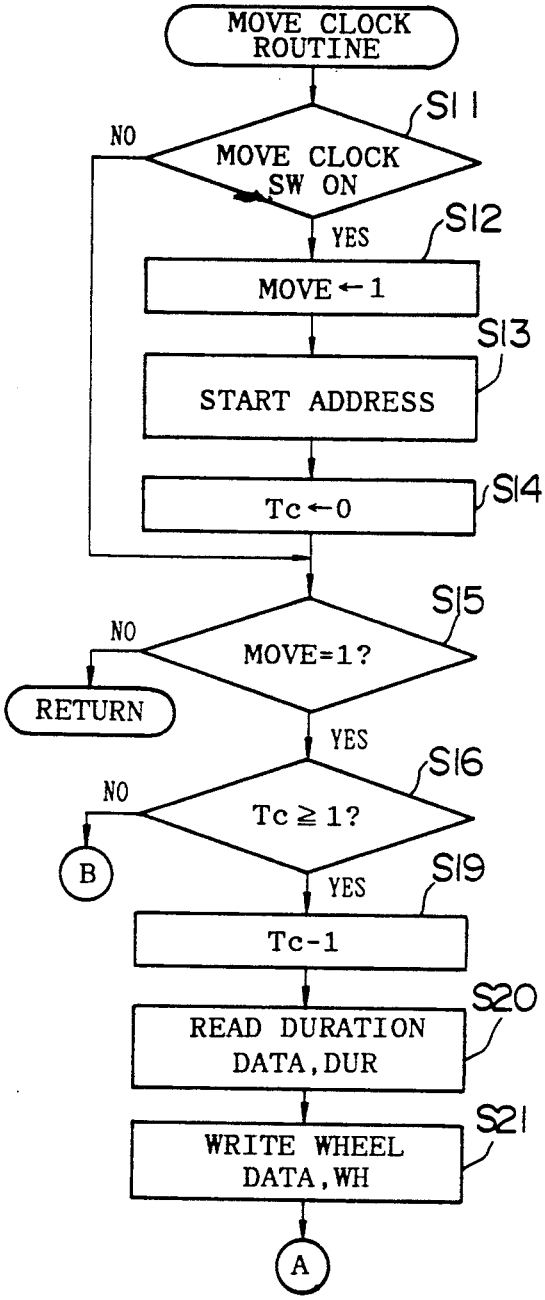
FIGS. 8 (*a*), (*b*) and (*c*) are flow charts to explain the steps involved in move clock routine and the transfer process of the tone generation timing.
Figure 8B:
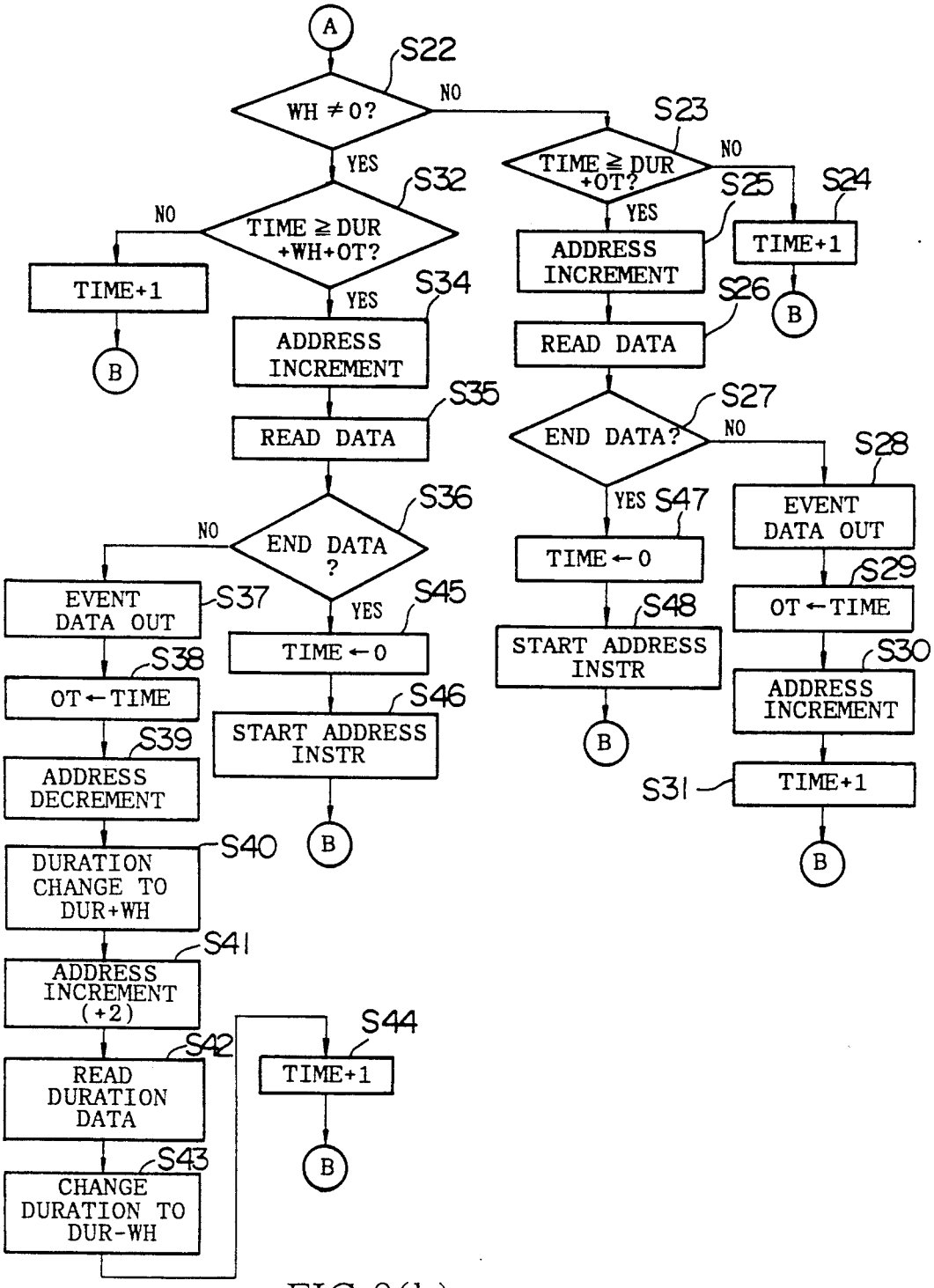
Figure 8C:
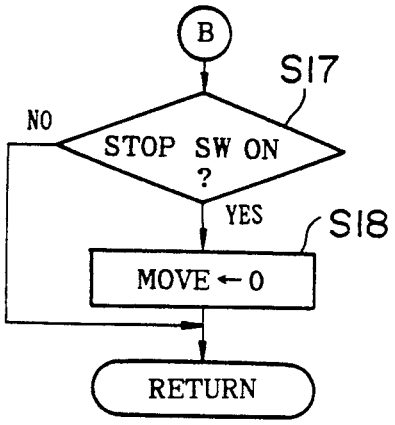

In step S4, the move clock routine, shown in FIG. 8 (*a*) to (*c*), is activated, and the path proceeds to step S11, in which the switch circuit 9 is scanned to determine the operating status, whether the OFF status is changed to ON status, of the move clock switch 25. If the move clock switch 25 has not been operated and is unchanged, the program path results in [NO] in S11, and it proceeds to step S15 to check if the move clock flag MOVE is "1". In this particular case, the move clock flag MOVE has been initialized to "0" in S1, and the path takes to [NO] and the step reverts to step S5 of the main routine.

In step S5, pattern play processing is performed. That is, when the operation mode is "pattern play" mode, a tone generation command is issued to the tone generation circuit 12 to generate a tone based on the stored automatic play data in the rhythm pattern memory location of RAM 4. In this case, the apparatus is set in the pattern play mode if the operator presses the play switch 21 first, followed by the start switch 23, and is cancelled if it is followed by the stop switch 24. In step S6, other operations, such as volume adjustments, are carried out to correspond with the instruction data. Henceforth, the steps S2 to S6 are repeated.

Figure 7:
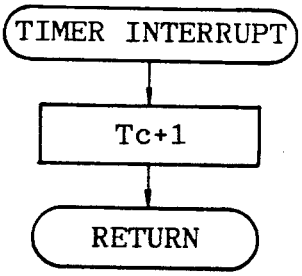
Figure 9:
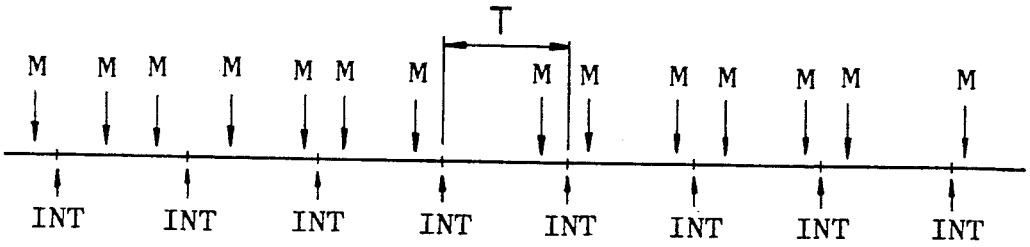
FIG. 9 illustrates the relationship between the timings of main routine activation and timer interrupt routines.

FIG. 9 illustrates the operating process of CPU 1. In this figure, M with an arrow indicates the timing of step S2 of the main routine. The main routine and the accompanying move clock routine contain branching decision steps, and the main routine is not always executed at a constant interval. For this reason, even if a count routine is provided for in the main routine to keep track of time, because of the non-periodicity of the execution of the count routines, such counts cannot be utilized for the generation of duration data or the timing data based on the duration data. In this embodiment, therefore, a system is devised in which every time a timer interrupt signal INT having a period T is generated, the CPU 1 executes the interrupt routine shown in FIG. 7, and increments the timer count register TC which is used as the elapsed time reference within the move clock routine.

Suppose the operator turns on the move clock switch 25, the move clock routine is activated via step S4, and the path in step S11 goes to [YES] and proceeds to step S12, to set the move flag to "1". In step S13, the start address, the storage address for the duration data DU1 in FIG. 3, is set in the address register ADR which specifies read/write addresses of RAM 4. In step S14, the timer count register TC is cleared and its content is set to [0]. Since the move flag MOVE is "1", the path in step S15 goes to [YES], and it proceeds onto step S16.

At this time, the content of the timer count register TC is checked to examine whether it is equal to or over 1. If the timer count has not been operated since the execution of step S14, then the content would be TC=[0], and the path goes to [NO], and it returns to the main routine through step S17 shown in FIG. 8 (c).

On the other hand, if the timer interrupt routine is activated, the content of the timer count register is incremented by the number of times it has been activated. When the path proceeds onto step S16 as the result of the activation of the move clock routine, the path in step S16 goes to [YES], and it proceeds onto step S19. At this time, the content of the timer count register TC is decremented by 1. By such steps, every time the activation of the timer interrupt routine causes the content of the timer count register TC to equal to or over 1, the steps subsequent to step S19 are carried out to decrement the content of the timer count register TC.

Proceeding onto step S20, the first duration data DU1 are read from RAM 4 according to the content of the address register ADR, and the duration data DU1 are stored in the duration register DUR. In step S21, the wheel circuit 6 is scanned, and the wheel value is entered into the wheel value register WH. At this time, if the operator turns the wheel 5 in the negative direction in order to advance the rhythm tone generation timing, a negative value, corresponding to the amount of turns of the wheel 5, is entered into the wheel value register WH while the operator turns the wheel in the positive direction in order to delay the tone generation timing, a positive value corresponding to the amount of turns of the wheel 5 is entered into the wheel value register WH. If the operator had not moved the wheel 5, a [0] is entered into the wheel value register WH.

Next, the program advances to step S22 shown in FIG. 8 (b) to examine whether the wheel value register WH is some number other than [0]. If the operator had not turned the wheel 5, then the path goes to [NO], and it proceeds onto step S23. Here, it examines whether the content of the time register TIME is equal to or greater than the sum of the duration register DUR and the preceding time register OT. That is, it examines whether or not it is time to generate rhythm tone. If the result is [NO], it proceeds onto step S24 and increments the content of the time register TIME by 1, and returns to the main routine through step S17 shown in FIG. 8 (c). When the move clock routine is activated through the step S4 and if the content of the timer count register TC is over 1 in step S16, it proceeds onto step S19 and after incrementing the timer count register TC, it proceeds onto step S20, in which duration data are read from the RAM 4 according to the content of the address register ADR and are stored in the duration register DUR. At this time, the content of the address register ADR is the same as that which existed in step S20 during the previous cycle. The duration data DUR 1 is then stored in the duration register DUR. It proceeds onto step S22 through the step S21, and if the wheel has not been operated, the path goes to [NO], and it proceeds onto step S23. Henceforth, it repeats the steps as described above until the content of the time register TIME becomes equal to the sum of the contents of the duration register DUR and the preceding time register OT.

Again, the move clock routine becomes activated, and in step S23, if the path goes to [YES], it proceeds onto step S25, and increments the content of the address register ADR. The result is that the content of the address register ADR becomes the storage address of the event data IV1 shown in FIG. 3. In step S26, the memorized data specified by the address register ADR in RAM 4, i.e. the event data IV1 is read. In step S27, it examines whether or not the read data is the end data ED. If the path goes to [NO], it proceeds onto step S28, and forwards the event data IV1 onto the tone generation circuit 12, thereby generating a rhythm tone according to the event data IV1 from the sound system 13.

Proceeding onto step S29, the content of the time register TIME is entered into the preceding time register OT. In step S30, the content of the address register ADR is incremented, and the result is that the content of the address register ADR becomes the storage address of the duration data DU2 shown in FIG. 3. After incrementing the time register TIME in step S31, it returns to the main routine via the step S17 shown in FIG. 8 (c).

As described above, the processing steps beyond the step S19 are carried out when the content of the timer count register TC is equal to or over 1. During these steps, the timer count register TC is decremented (in S19) while the time register TIME is incremented (steps S31, S24 and S44, S 33 which will be explained later). The result is that the time register TIME increases, as the timer interrupt events occur and increments the register TC, and the value of the time register TIME increases roughly proportionally with elapsed time.

Suppose an operator rotates the wheel 5 thereby activating the move clock step S22, the path opts to [YES] and it proceeds to the step S32. In this step, it examines whether or not the content of the time register TIME is equal to or greater than the sum of the contents of the duration register DUR, the preceding time register OT and the wheel value register WH. If the operator had turned the wheel 5 in the negative direction, the value (DUR+WH+OT) is less than the original value (DUR+OT), by the value of the wheel rotation in the register WH before touching the wheel, and if the wheel had been turned in the positive direction, the value (DUR+WH+OT) is larger than the original value (DUR+OT) by the value of the wheel rotation in the register WH.

When the time value in the time register TIME has not reached the time to generate rhythm tone, and when the path in step S32 opts to [NO], it proceeds to the step S33, and increments the time register, and returns to the main routine via S17. On the other hand, if the time value in the time register TIME has the tone generation time, and when the path opts to [YES] in step S32, then it proceeds to the step S34, and increments the address register ADR. The result is that the content of the address register ADR becomes the storage address of the event data IV2 shown in FIG. 2. In step S35, the event data IV2 is read from RAM 4 according to the content of the address register ADR, and in step S36, it decides whether the read data is the end data ED or not. If the read data is not the end data ED, the path opts to [NO] in S36, and it proceeds to the step S37, and the event data IV2 is forwarded to the tone generation circuit 12. The result is the generation of a tone according to the event data IV2 from the sound system 13. Proceeding onto the step S38, the content of the time register TIME is entered in the preceding time register OT. In step S39, the address register ADR is decremented, and the result is that the content of the address register ADR becomes the storage address for the duration data DU2 which specifies the duration value of the event data IV2. In step S40, the contents of the duration register DUR and the wheel value register WH are summed, and the resulting duration value, i.e. greater (positive rotation) or lesser values (negative rotation) than the original duration value is entered into RAM 4 as the duration data DU2. The process of transfer of the tone generation timing for the event data IV2 is thus carried out. Proceeding onto the step S41, the address register ADR is incremented by 2, which becomes the storage address for the duration data DU3. The data DU3 is read according to the content of the address register ADR, and entered in the duration register DUR. Next, the content of the wheel value register WH is subtracted from the content of the duration register DUR, and the remainder value is entered in RAM 4 as the duration data DU3 for the event data IV3.

As described above, the duration data DU3 is updated in such a way to annihilate the changes associated with the duration data DU2, only the timing changes associated with the event data IV2 are allowed, and the timing of the event data subsequent to the event data IV3 remain unchanged. In step S44, the time register TIME is incremented, and the step returns to the main routine via S17 shown in FIG. 8 (*c*).

In the subsequent steps, rhythm tone generation process is carried out in the same manner as described above according to the musical playing data in RAM 4, and if the wheel 5 is operated, data alteration takes place on the duration data immediately following the relevant event data. If the end data ED (refer to FIG. 3) is read in step S26, and if the move clock processing routine is activated while the wheel 5 is untouched, the path in step S27 opts to [YES], and it proceeds to the step S47 to enter [0] in the time register TIME. Proceeding onto the step S48 to designate the content of the address register ADR as the start address (i.e., the storage address of the duration data DU1), and it returns to the main routine via S17. The procedure for dealing with the case of the end data ED being reached while the operator is operating the wheel 5 (step S35) is identical to the above processing procedure; that is, the time register TIME is cleared (step S45), start address in entered in the address register ADR (step S46), and it returns to the main routine via S17. Thus are processed data corresponding to one rhythm pattern, and the subsequent steps are repeated to generate the rhythm tone, incorporating the changes, if demanded by the wheel 5.

The termination of duration data alterations is carried out by pressing down the stop key 24. If the move clock processing routine is activated after the stop key 24 has been pressed down, the path in step S17 in FIG. 8 (*c*) opts to [YES], and after proceeding onto the step S18 and setting the move flag MOVE to "0", it returns to the main routine. If the move clock routine is activated subsequently, the path in step S15 opts to [NO], and it returns to the main routine without going further than the step S19.

The above embodiment related to the case of transferring the rhythm pattern generation timing, but it is obvious that the same technique can be applied to transfer the automatic musical tone generation timing.

Further, the above embodiment illustrated a case of the duration data for all the rhythm patterns stored in RAM 4, by providing a facility to specify a tone color, the apparatus would become even more convenient for altering only the duration data concerning the event data associated with a particular tone color.

Further, the duration data alteration procedure is not limited to the step flow presented in the above embodiment. For example, within the move clock processing routine, the time register TIME is incremented by monitoring the content of the timer count register TC, but the same purpose can be served by incrementing the time register TIME within the timer interrupt routine for management of the elapsed time by the time register alone.

Further, the operating element for transferring the tone generation timing is not limited to the form of a wheel, and other suitable components such as switches and joy sticks can also be utilized.

Further, the mechanism for the operating element for transferring the tone generation timing can be made as a stepped device having an audible click to correspond to a given amount of transfer of the tone generation timing. For example, each click can be made so that the first click (a step) can be made to correspond to an amount equal to a 32nd tone and the second click to a 16th tone. By having such an arrangement, it becomes easier to recognize the amount of transfer which is been made and to identify its possible effect on the music score while performing the altering operation.

What is claimed is:

1. An automatic musical data editing apparatus comprising:

(a) memory means for storing automatic musical play data comprising:
event data for controlling musical playing and timing data for controlling a generation of timing of said event data;

(b) a manually operable member for changing the generation timing of said event data in an automatic performance mode and generating an operation signal in accordance with the operation;

(c) a timing alteration data generating means for generating timing alteration data in accordance with the operation signal from said operating means;

(d) altering means for altering the timing data in accordance with the timing alteration data, and outputting the event data in accordance with the altered timing data; and (e) tone generation means for generating musical tones in accordance with the data outputted from said altering means, the musical tones being generated in the automatic performance mode.

2. An automatic musical data editing apparatus as claimed in claim 1, wherein said timing data for controlling the timing of musical playing are rhythm pattern generation timing.

3. An automatic musical data editing apparatus as claimed in claim 2, wherein said timing data for controlling the timing of musical playing are tone generation timing data.

4. An automatic musical data editing apparatus as claimed in claim 2, the timing data further comprising duration data representing intervals of the event data.

5. An automatic musical data editing apparatus as claimed in claim 4, wherein said operating means alters only the duration data associated with particular tone color.

6. An automatic musical data editing apparatus as claimed in claim 1, wherein the movable member of the operating means comprises a wheel.

7. An automatic musical data editing apparatus as claimed in claim 2, wherein the altering means alters the rhythm pattern generation timing.

8. An automatic musical data editing apparatus as claimed in claim 1, wherein the manually operable member comprises a movable lever, and the timing alteration data generating means generates the timing alteration data according to the operation and the direction of the movable lever.

9. An automatic musical data editing apparatus comprising:

(a) memory means for storing automatic musical play data comprising:

event data for controlling musical playing and timing data for controlling a generation timing of said event data;

(b) a manually operable member for changing the generation timing of said event data in an automatic performance mode and generating an operation signal in accordance with the operation;

(c) a timing alteration data generating means for generating timing alteration data in accordance with the operation signal from said operating means;

(d) replacing means for altering the timing data in accordance with the altered timing data; outputting event data in accordance with the altered timing data; and replacing said timing data with said altered timing data in said memory; and (e) tone generation means for generating musical tones in accordance with the event data outputted from said replacing means in the automatic performance mode.

10. An automatic musical data editing apparatus as claimed in claim 9, wherein said altered timing data is in proportion to the operation of said operating means.

11. An automatic musical data editing apparatus as claimed in claim 9, wherein said timing data consist essentially of duration data representing intervals of said event data; said replacing means alters current duration data, and subsequent data is also altered in accordance with the amount of alteration.

12. An automatic musical data editing apparatus as claimed in claim 9, wherein said automatic musical play data comprises a plurality of part data corresponding to a plurality of tone color data; wherein said replacing means includes tone color directive means which specify one tone color from said plurality of tone colors; and wherein said replacing means alter only the timing data in said part data specified by said tone color directive means.

13. An automatic musical data editing apparatus as claimed in claim 9, wherein the manually operable member comprises a movable lever, and the timing alteration data generating means generates the timing alteration data according to the operation and the direction of the movable lever.

* * * * *